United States Patent [19]

Nordstrom et al.

[11] 3,942,619

[45] Mar. 9, 1976

[54] PRINTER EMPLOYING STYLUS CORRELATION AND MOTOR DAMPING MEANS

[75] Inventors: Larry A. Nordstrom, Oveido; Daniel J. Szechy, Sanford, both of Fla.

[73] Assignee: Scope, Incorporated, Reston, Va.

[22] Filed: July 16, 1973

[21] Appl. No.: 379,241

[52] U.S. Cl. ..... 197/1 R; 318/696

[51] Int. Cl.[2] ..... B41J 1/60

[58] Field of Search ..... 197/1, 48, 49; 101/93 C; 318/696, 138, 685, 254; 178/30

[56] References Cited

UNITED STATES PATENTS

| | | | |
|---|---|---|---|
| 3,232,404 | 2/1966 | Jones | 197/49 |
| 3,324,369 | 6/1967 | Markakis | 318/138 |
| 3,345,547 | 10/1967 | Dunne | 318/696 |
| 3,353,076 | 11/1967 | Haines | 318/696 |
| 3,366,214 | 1/1968 | Tutert et al. | 197/48 |
| 3,554,347 | 1/1971 | Perkins | 197/48 |
| 3,660,746 | 5/1972 | Milek | 318/696 |
| 3,700,807 | 10/1972 | Drapeau | 178/30 |
| 3,736,487 | 5/1973 | Cook et al. | 318/696 |
| 3,767,993 | 10/1973 | Yablonski | 318/696 |

*Primary Examiner*—Edgar S. Burr
*Assistant Examiner*—R. T. Rader
*Attorney, Agent, or Firm*—Duckworth, Hobby & Allen

[57] ABSTRACT

Printing apparatus including a multi-phase stepping motor having a shaft rotated thereby, and detecting means opto-electronically coupled to the shaft. A printing stylus is mechanically coupled with the shaft such that the shaft drives the stylus along a path. A control circuit coupled with the opto-electronic detecting means correlates signals to the stylus with the position of the shaft.

21 Claims, 4 Drawing Figures

PRINTER EMPLOYING STYLUS CORRELATION AND MOTOR DAMPING MEANS

BACKGROUND OF THE INVENTION

1. Field of the Invention

The present invention relates to motor-driven printing apparatus, and in particular relates to techniques for correlating the printing stylus with the motor shaft position, for damping the printer motor to avoid unwanted oscillations at the end of each motor movement, and for providing a smooth transition of the motor from the step mode to the slew mode of operation.

2. Description of the Prior Art

Stepping motors are employed in a wide variety of applications. These motors utilize a plurality of independent windings, each winding being capable of rotating the motor shaft through an increment of a complete cycle.

In particular, such multiphase stepping motors are employed with serial printers to drive the printing stylus along a multiple position path, each position along the path corresponding to a single motor step. In U.S. Pat. Nos. 3,685,629 to Rott, and 3,700,807 to Drapeau, both of which are assigned to the assignee of the present invention, there is disclosed an impactless printer employing a stepping motor-driven stylus having a column of electrodes adapted to contact a treated paper. The stylus electrodes are selectively energized during transverse movement of the stylus across the paper to form a character at each position along the path of the stylus. Character information to the stylus electrode has heretofore been clocked at a rate which assumes that a portion of the motor step has a constant velocity. However, the stepping motor is often subjected to variations in operating voltage, motor temperature, friction, and a variety of other factors. When such occurs, the motor pulse response changes and the resulting printed character is often distorted.

The stepping motors employed in printing apparatus like that described above are high inertia, low friction components, such stepping motors tend to exhibit relatively large shaft oscillations at the end of each step, due to this low friction characteristic. If the shaft oscillations from any given step continue during the printing of a character in the next succeeding motor step, a distorted character will also result.

Techniques have been developed in the prior art for damping the above-described oscillations by applying a reverse pulse to a previously energized motor phase to brake the shaft. However, such braking pulses are not generally correlated to the shaft position, and therefore may not occur at an optimum time.

Another stepping motor control arrangement employs a shaft-mounted disc having striations thereon, and a photodetector circuit to correlate control signals to the motor with the position of the shaft. Examples of this arrangement are described in the following U.S. Pat. Nos.: 3,353,076 to Haines; 3,324,369 to Markakis; 3,345,547 to Dunne; 3,424,967 to Keller; 3,549,975 to Ferris; 3,484,666 to Easton; 3,328,662 to Gambil; 3,311,803 to Schulz; 3,510,742 to Pooley and 3,660,746 to Milek.

SUMMARY OF THE INVENTION

The present invention contemplates apparatus comprising a motor having a shaft with, and rotated by the motor. Means are mechanically coupled with and driven by the shaft along a path, and circuit means are coupled with the path means and adapted to provide signals thereto during movement along the path. The apparatus further includes means coupled with the shaft and the electrical circuit means for correlating each signal from the circuit means with a predetermined position of the shaft.

THE DRAWING

Figure 1:
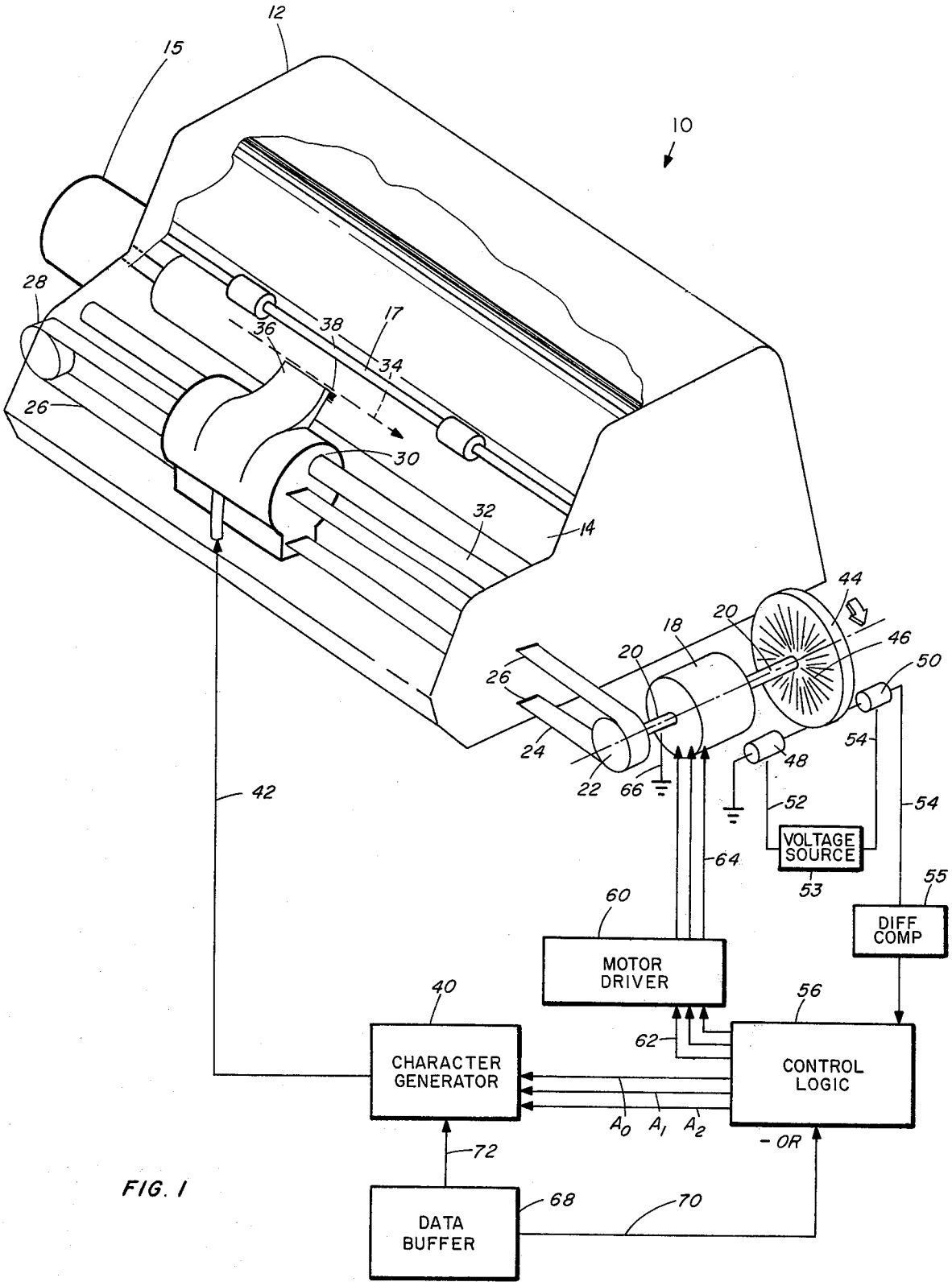
FIG. 1 is a perspective view, partially in block circuit diagram, of a portion of printing apparatus embodying the present invention.
Figure 2:
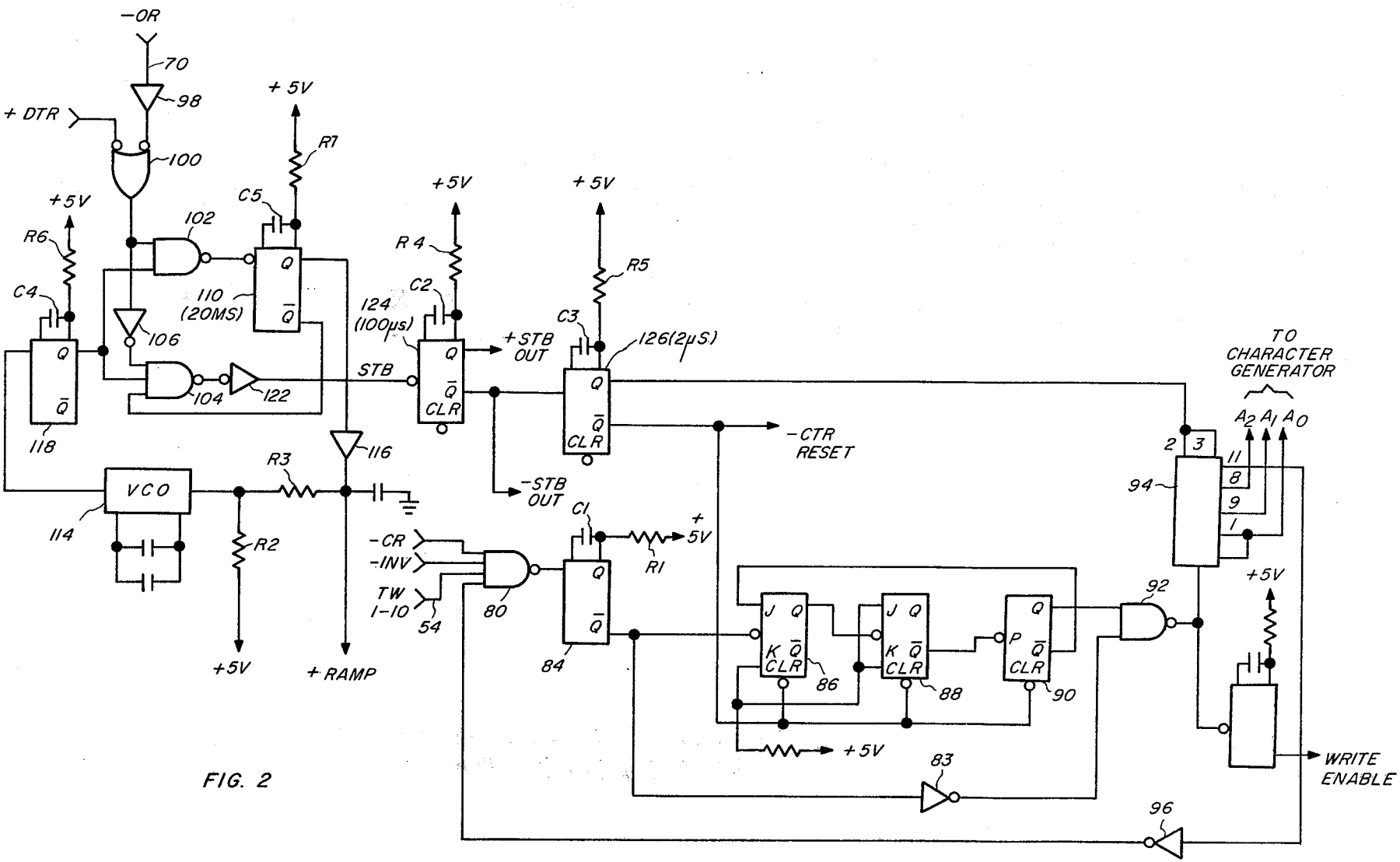
FIG. 2 is a schematic circuit diagram representing a portion of the circuit represented in FIG. 1.
Figure 3:
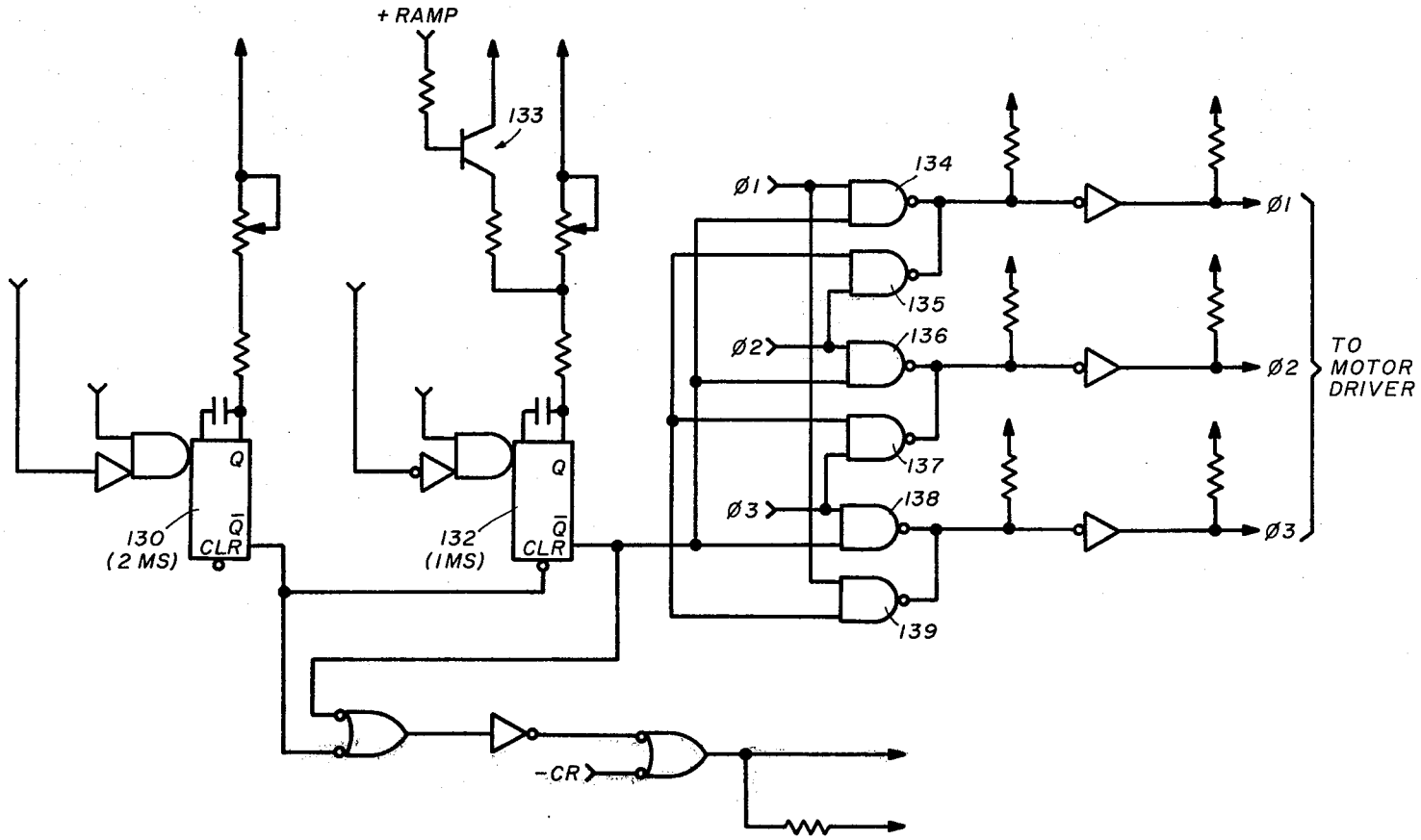
FIG. 3 is a schematic circuit diagram representative of a portion of the circuit in FIG. 1.
Figure 4:
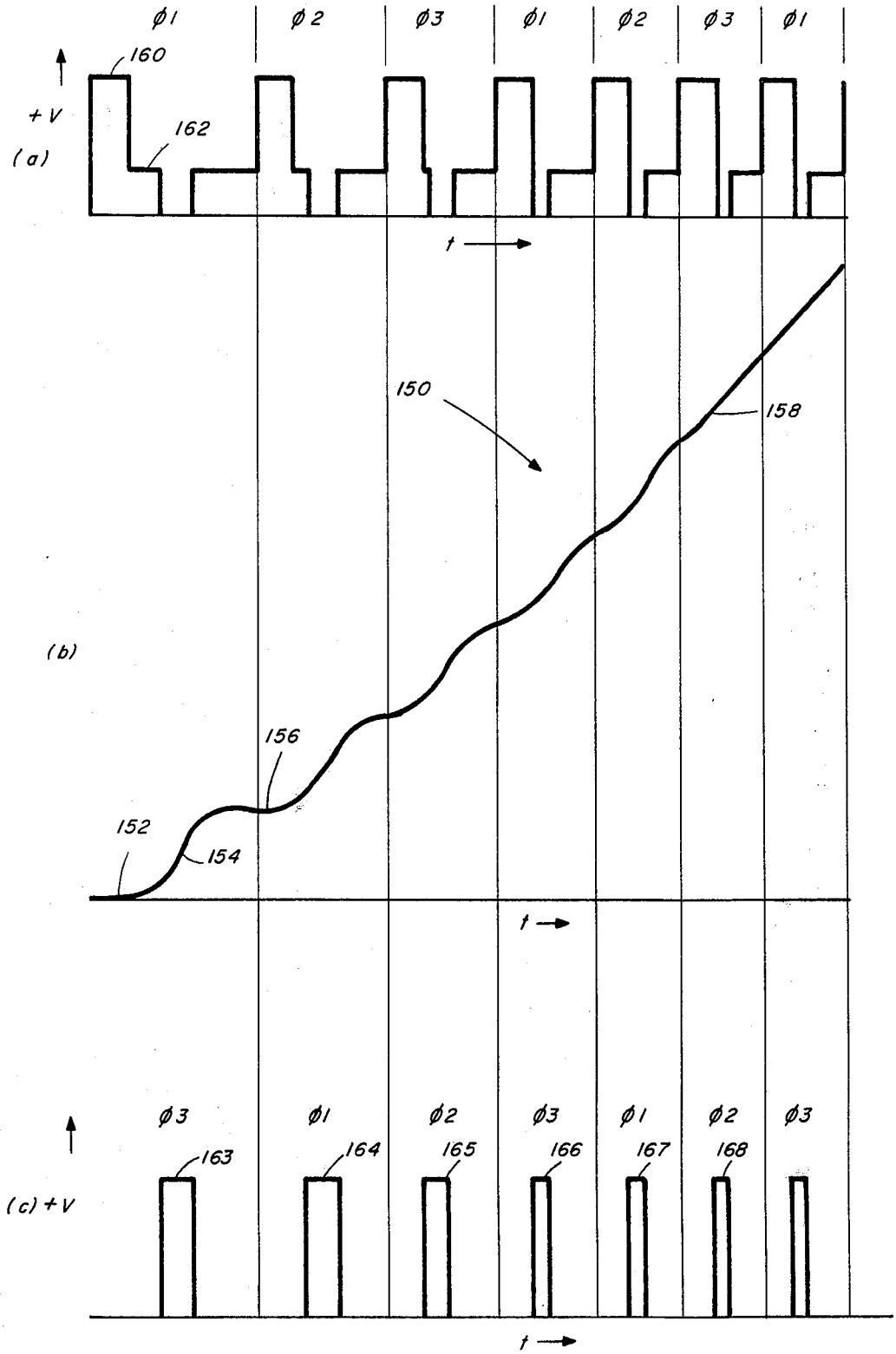

FIGS. 4(*a*), (*b*) and (*c*) are plots respresentative of motor energization, pulse response, and braking pulses, respectively, measured with the apparatus of FIGS. 1–3.

DETAILED DESCRIPTION

Printing apparatus employing the present invention will be described with reference to FIG. 1.

The printing apparatus, referred to generally as 10, includes a frame 12 which is positioned within a printer housing (not shown). A roller 14 is rotatably supported by the frame 12 such that a paper sheet may be passed between the roller 14 and a conductive paper guide 17. The roller 14 is driven by a motor 15 positioned along one side of the frame 12.

The printer 10 further includes a multi-phase stepping motor 18 having a shaft 20, with a belt pulley 22 fixed at one end of the shaft. A continuous drive belt 24 extends through apertures 26 in the frame 12 and is tensioned about another rotatable belt pulley 28 along a side of the frame opposite the stepping motor 18. A printing head 30 is movably mounted on a guide rail 32 fixed between two sides of the frame 12. The printing head 30 is fixed to the belt 24 so as to be driven by rotation of the shaft 20 along a multiple position path (indicated by an arrow 34) transverse across the paper, each position along the path 14 corresponding to one step of the motor 18. The print head 30 includes a printing stylus 36 having a single column of electrodes 38 extending from the stylus and contacting the paper.

The printer 10 further includes a character generator circuit 40 electrically coupled via circuit line 42 to the print head 30 and thus to the stylus 36 and electrodes 38.

In accordance with the present invention, the printer 10 includes means for correlating signals from the character generator 40 to the stylus 36 with the position of the shaft 20, in order to avoid the printed character distortion difficulties discussed above. In this embodiment, the correlation means comprises a timing wheel 44 fixed on one end of the shaft 20 of the stepping motor 18. The timing wheel 44 comprises a transparent disc having a plurality of striations 46 equally spaced about the disc and extending radially from the motor shaft 20. A photo emitter 48 and a photo sensitive device 50 are positioned in axial alignment on opposite sides of the timing wheel 44, so as to establish an optoelectronic circuit therebetween, which circuit is completed except when one of the striations 46 is interposed along the path between the photo emitter 48 and the photo sensor 50.

The particular dimensions of the timing wheel 44 and the striations 46 are not critical. For purposes of this embodiment, it is preferable to employ 10 striations for each step, or phase of the motor 18, as is described below in greater detail. The photo emitter 48 and the photo sensor 50 may comprise any of a variety of light-emitting diodes and light sensitive diodes, respectively.

The photo emitter 48 and the photo sensor 50 are coupled via respective circuit lines 52 and 54 to a voltage source 53. The photo sensor 50 is further coupled through a differential comparator 55 to a control logic circuit 56, which includes logic circuitry therein for counting signals from the photo sensor 50 representative of successive striations 46. Details of the control logic circuit will be described below with reference to FIGS. 2 and 3.

The control logic circuit 56 is coupled to the character generator 40 through circuit lines $A_0$, $A_1$ and $A_2$ and to a motor driving circuit 60 through plural circuit lines 62, each for one phase of the motor 18. The motor driving circuit 60 is coupled to the stepping motor 18 via corresponding plural circuit lines 64, the other terminal of the stepping motor being coupled to a positive voltage at 66.

A data buffer circuit 68 is associated with the printer 10 and is coupled to the control logic circuit 56 by a circuit line 70 and to the character generator 40 by another circuit line 72.

In operation, the control logic circuit 56 counts the striations 46 and for preselected striations signals the character generator 40, which in turn correlates character data signals to the stylus electrodes 38 with a corresponding position of the motor shaft during each motor step. In the printer 10 of the present embodiment the printer characters are formed, as described above, when the column of electrodes 38 are selectively energized during movement of the print head 30 so as to form a series of dots and thereby print the desired character. However, the correlation means described above may likewise be employed with other types of printers.

The control logic circuit 56 will now be described in detail with reference to FIGS. 2 and 3.

The control logic circuit 56 includes a four-input NAND gate 80. One input TW to the NAND gate 80 comprises the circuit line 54 which couples that input to the photo sensor 50 through the differential comparator 55. Other inputs to the NAND gate 80 include carriage return CR and invalid code INV. The output of the NAND gate 80 is coupled to one input of a monostable multivibrator (one shot) circuit 84, having Q and $\overline{Q}$ (bar Q) terminals, as is well known. The one-shot circuit 84 has a time delay period represented by an RC time constant determined by a resistor $R_1$ and a capacitor $C_1$ coupled thereto. The $\overline{Q}$ output of the one shot circuit 84 is coupled to a clock input of a JK flip-flop circuit 86. The Q output of the JK flip-flop 86 is coupled to a clock input of another JK flip-flop circuit 88. The K inputs of both flip-flops 86, 88 and the J input of the second flip-flop 88 are coupled together to a constant voltage source, which, in this example, suitably comprises +5 volts. The $\overline{Q}$ output of the second flip-flop 88 is fed into a D flip-flop circuit 90, the $\overline{Q}$ output of which is returned to the J input of the first JK flip-flop 86. The clear CLR terminal of all three flip-flops 86, 88 and 90 are coupled to a counter reset terminal, which will hereinafter be described.

The Q output of the D flip-flop circuit 90 is coupled to a NAND gate 92, the output of which is coupled to the input of a binary counter circuit 94. The binary counter 94 includes a plurality of outputs, four of which are labeled 1, 9, 8 and 11, outputs 1, 9 and 8 being coupled to the character generator 40 as circuit lines $A_0$, $A_1$ and $A_2$, respectively. Output 11 of the binary circuit 94 is coupled through an inverter 96 back to the NAND gate 80 as the fourth input thereto.

Reference is now made to the left-hand portion of FIG. 2, where there is shown an input designated —OR. This input is received into the control logic circuit 56 via circuit line 70 from the buffer circuit 68. (Note FIG. 1). This signal is indicative of the presence of data stored in the buffer 68, and is inverted at 98 and fed into a NOR gate 100 having another input represented as +DTR, or "Data Terminal Ready", a condition indicating that the printer 10 is operational and ready to print.

The output of the NOR gate 100 is fed to two NAND gates 102 and 104, the input to the second NAND gate 104 being inverted at 106. The output of NAND gate 102 is inputted into a one shot circuit 110 having an RC time delay of about 20 milliseconds, as determined by the resistor $R_7$ and capacitor $C_5$ associated therewith. The $\overline{Q}$ output of the one shot 110 is coupled to the NAND gate 104, and the Q output thereof is coupled through a resistor $R_3$ to the input of a voltage controlled oscillator (VCO) 114 through an open collector inverter 116. Another resistor $R_2$ is coupled between the VCO input and to the constant 5 volt voltage source. The output of the VCO 114 is coupled to another one shot circuit 118. The Q output of the one shot 118 is coupled to the inputs of the NAND gates 102 and 104. One shot circuit 118 includes an RC time delay determined by resistor $R_6$ and capacitor $C_4$.

The output of the NAND gate 104 is inverted at 122 and identified as a strobe - STB imput to a one shot circuit 124, the $\overline{Q}$ output of which is coupled to another one shot circuit 126. The one shot circuit 124 has a resistor $R_4$ and a capacitor $C_2$ determining the time delay period, which time delay in this example, is suitable 100 microseconds. The other one shot 126 also has RC delay of 2 microseconds determined by resistor $R_5$ and and capacitor $C_3$. The Q output of the one shot circuit 126 is coupled to inputs 2 and 3 of the binary counter 94. The $\overline{Q}$ output of the one shot circuit 126 comprises the counter reset signal, as described above, which is coupled to the clear CLR terminals of the flip-flops 86, 88 and 90.

That portion of the control logic circuit 56 shown in FIG. 2 and described above functions in the following manner. As noted previously, it is suitable for purposes of the printer 10 to employ 10 striations 46 per step of the motor 18. Thus for each step, ten pulses will input to the NAND gate 80, each pulse representing one striation. The first strobe (—STB) pulse for each step is delayed by the one shot circuit 124 for 100 microseconds, in order to detect an invalid INV code to thereby inhibit a column count and a motor step. Subsequent to the 100 microsecond delay, the counter reset ($\overline{Q}$) output of the one shot circuit 126 sets the three flip-flops 86, 88 and 90.

Striation pulses 1–10 are then shaped by the one shot circuit 84. Because the J and K inputs of the two flip-flop circuits 86 and 88 are high, these flip-flops "toggle", i.e. change state, for each clock pulse from the one circuit 84. (Note FIG. 2). Thus the two input NAND gate 92 sees counts 2 through 9, which are fed into the binary counter 94.

Striation counts 2–8 are thereafter fed into the character generator 40 as binary inputs $A_0$, $A_1$ and $A_2$, as each of the respective terminals of the counter go high. On the ninth striation count, terminal 11 of the binary counter goes high, is inverted low at 96, and thereafter shuts down the NAND gate 80 until the flip-flops 86, 88 and 90 are reset by the counter reset output of the one shot circuit 126.

Reference is now made to the VCO 114. With the absence of data in the buffer 68, the inverter 116 keeps the input to the VCO at a low voltage, on the order of 2.5 volts, causing the VCO to oscillate at a relatively low frequency. The output of the VCO is fed into the one shot circuit 18 which applies the VCO pulses into the NAND gate 102, the output of which fires the one shot circuit 110. The circuit 110 delays 20 milliseconds, and the Q output is inverted low at 116 to keep the VCO 114 oscillating at the low frequency. At the same time, the $\overline{Q}$ output of the one shot circuit 110 prevents the NAND gate 100 from providing a STB output into the one shot circuit 124.

When data is stored in the buffer 68, a negative OR signal is fed into the control logic circuit 56 and is inverted at 98. Assuming that the printer 10 is operational and ready to print, the output of the NOR gate 100 will go positive, preventing further VCO pulses through the NAND gate 102. At the end of the next 20 millisecond delay, the NAND gate 104 opens, allowing the VCO pulses through that gate as inverted −STB inputs to the one shot circuit 124. At the same time, the condition of the open collector inverter 116 causes the input to the VCO 114 to begin ramping up to about 5 volts. This causes the VCO to oscillate at a rapidly increasing frequency, resulting in a commensurate increase in the rate of the −STB input.

The $\overline{Q}$ output of the one shot circuit 124 is delayed 100 microseconds, allowing sufficient time for the NAND gate to recognize an INV or CR code. The binary counter circuit 94 is thereafter strobed with the Q output of the second one shot circuit 126, at terminals 2 and 3. The $\overline{Q}$ output of this one shot circuit 126 serves as a counter reset.

In summary, the counter circuit, including the three clip-clops 86, 88 and 90 count the 10 striation pulses for each motor step and instruct the character generator at a repetition rate determined by the striation pulse inputs to the binary counter 94. The counter circuit is reset at the beginning of each motor step, thus providing a positive reference point.

The manner in which the strobe STB rate begins a relatively low rate initially and ramps up to a high rate is of particular importance to the present invention, as is more fully described with reference to FIGS. 4(*a*) and (*b*).

As shown in the motor pulse response curve 150 in FIG. 4(*b*), the first motor step energized during a line of printing begins with a relatively slow start, due to friction and inertia (note portion 152 of curve 150). Thus, the linear portion 154 of that first motor step occurs relatively late. However, at the beginning of the next motor step at portion 156 of curve 150, the motor shaft has developed angular momentum and the non-linear "start-up" period is relatively less than the previous phase. This continues in succeeding phases, until the curve 150 becomes practically linear, as is shown at portion 158. By ramping up the strobe rate from a low rate to a higher rate, character distortion during the non-linear portions of the first few phases of each line can be avoided. Thereafter, the stepping motor can be ramped up to a slew rate desirable for high speed printing.

As shown in FIG. 3, the control logic circuit 56 also includes logic coupled with the motor driver 60. This logic includes two one shot circuits 130 and 132 and six open collector NAND gates 134–139 coupled as shown to provide energizing signals to three motor phases through the motor driver circuit 60. This circuit energizes the preceding phase coincident with the fifth striation pulse from the timing wheel 44 to brake the motor shaft 20 and damp the oscillatory motion described above. When the VCO 114 is ramping up, the preceding phase is energized for 1 millisecond as determined by the RC network of one shot circuit 132. When the VCO 114 has increased in frequency to a slew rate, the duration of energization for the preceding phase is decreased to 0.5 millisecond as controlled by the parallel transistor current source 133, coupled to the one shot circuit 132.

Operation of this circuit is more clearly seen with reference to FIGS. 4(*a*) and (*c*). As shown in FIG. 4(*a*), each phase (assuming a three phase motor) receives a 2 millisecond boost voltage 160 at the beginning of each step. Thereafter, a detent voltage 162 is applied coincident with the fifth striation pulse, the phase energized immediately preceding is pulsed at the boost voltage level. Initially, this brake voltage preferably has a duration of about 1.0 millisecond (note elements 163 and 165 in FIG. 4(*c*)) as determined by the RC network associated with the one shot circuit 132. However, as the VCO 114 ramps up, the transistor current source 133 changes the RC time constant, diminishing the period of each boost pulse to about 0.5 millisecond (note elements 166–168 in FIG. 4(*c*)). This is advantageous, since the motor requires less braking after entering the slew mode.

We claim:

1. Apparatus comprising:

a multiphase stepping motor having at least two phases and adapted to step one phase for each position along a path;

a shaft rotated by said motor;

means mechanically driven by said shaft along a path;

circuit means coupled with said mechanically driven means for providing signals thereto during movement along said path;

means coupled with said shaft and said circuit means for correlating each signal from said circuit means with a predetermined position of said shaft, said correlating means including a disc fixed on said shaft and having a plurality of striations thereon for each phase of said stepping motor;

means for energizing a first phase of said motor during energization of a second phase of said motor, in order to brake said shaft; and means for energizing said first phase only at a predetermined position of said shaft during energization of said second phase, said predetermined position energizing means including a control circuit coupled to an output of said correlating means for counting each striation of said disc and for energizing said first phase after counting a predetermined number of striations during energization of said second phase.

2. Apparatus as recited in claim 1 wherein said correlating means further comprises means for electromagnetically detecting each striation on said disc.

3. Apparatus as recited in claim 2 wherein said electromagnetic detecting means comprises:

radiant energy emitting means;

radiant energy sensitive means; and wherein said emitting and sensitive means are axially aligned each on opposing sides of said disc and adapted to complete an electromagnetic circuit except when one of said striations is positioned therebetween.

4. Apparatus as recited in claim 3 wherein said energizing means further comprises:

driving circuit means electrically coupled between said stepping motor and said control circuit, and adapted to provide signals to said stepping motor for sequentially energizing each of said stepping motor phases.

5. Printing apparatus comprising:

a multiphase stepping motor having at least two phases and adapted to step one phase for each position along a path;

a shaft rotated by said motor;

detecting means electromagnetically coupled to said shaft, said detecting means including a disc having a plurality of striations thereon for each phase of said stepping motor;

a movable printing stylus;

means mechanically coupling said stylus to said shaft such that said shaft drives said stylus along a path;

character generating means coupled with said stylus and adapted to provide character signals thereto during movement of said stylus along said path;

a control circuit coupled with said electromagnetic detecting means and said character generating means for correlating signals to said stylus with the position of said shaft;

means for braking said shaft; and means for energizing said braking means as a function of the position of said shaft, said energizing means including means with said control circuit for counting a predetermined number of striations on said disc during energization of one phase of said motor, and for providing a signal responsive thereto for energizing said braking means for a duration sufficient to prevent oscillatory motion of said shaft.

6. Apparatus as recited in claim 1 wherein said electromagnetic detecting means further comprises:

photo emitting means;

photo sensitive means; and wherein said photo emitting and photo sensitive means are axially aligned each on opposing sides of said disc and adapted to complete and electromagnetic circuit except when one of said striations is positioned therebetween.

7. Apparatus as recited in claim 6 further comprising:

driving circuit means electrically coupled between said stepping motor and said control circuit for providing a sequence of phasing signals to said motor for sequentially energizing each of said phases.

8. Apparatus as recited in claim 7 further comprising means for sequentially reducing the period of said energization signals with increases in the rotational speed of said motor.

9. Apparatus as recited in claim 5 further comprising:

data buffer means coupled to said character generator for storing data and thereafter providing input data thereto representative of a character to be printed by said stylus during movement through any given position along said path;

means with said control circuit and coupled to said buffer means for determining the presence of data in said buffer means; and strobing means with said control circuit for correlating character signals from said generator to said stylus with a corresponding striation, but only during the presence of data in said buffer means.

10. Apparatus as recited in claim 9 further comprising means coupled to said data determining means and said strobe means for initiating a predetermined time delay when data is not present.

11. Apparatus as recited in claim 10 wherein said control circuit further comprises strobe rate determining means electrically coupled to said strobing means.

12. Apparatus as recited in claim 11 wherein said strobe rate determining means comprises:

an open collector inverter coupled to said time delay means;

a voltage-controlled oscillator having its input coupled to said inverter;

a constant voltage source coupled to the input of said voltage-controlled oscillator;

two impedance means, each being electrically interposed between one of said inverter and said constant voltage source, and said voltage controlled oscillator; and wherein said voltage-controlled oscillator ramps up said strobe rate with voltage increases to the input thereof.

13. Printing apparatus comprising:

a multiphase stepping motor;

a shaft rotated by said motor;

a disc fixed on said shaft and having a plurality of radial striations thereon for each phase of said stepping motor;

electromagnetic detecting means for providing signals representative of successive striations;

means for receiving said signals from said detecting means and counting successive striations; and means for energizing a first phase of said motor coincident with the count of a predetermined striation detected by said counting means during energization of a second phase of said motor, in order to prevent oscillatory motion of said shaft.

14. Apparatus as recited in claim 13 further comprising means for reducing the period of energization of said immediately preceding phase with increases in the rotational speed of said motor.

15. Apparatus as recited in claim 13 further comprising:

a movable printing stylus mechanically coupled to said shaft and driven along a path thereby;

character-generating means coupled to said stylus and adapted to provide character signals thereto during movement of said stylus along said path;

a control circuit including said counting means and coupled to said detecting means and said character generator for correlating character signals to said stylus with said striation signals.

16. Apparatus as recited in claim 15 wherein said control circuit further comprises:

strobing means with said control circuit for correlating said character signals each with a corresponding striation; and strobe rate determining means coupled to said strobing means.

17. Apparatus as recited in claim 16 wherein said strobe rate determining means comprises means for increasing said strobe rate with increases in the angular momentum of said shaft during rotation thereof.

18. Apparatus as recited in claim 13 further comprising means for resetting said counting means at the end of a predetermined number of said striation signals.

19. Printing apparatus comprising:

a multiphase stepping motor;

a shaft rotated by said motor;

detecting means electromagnetically coupled to said shaft;

a movable printing stylus;

means mechanically coupling said stylus to said shaft such that said shaft drives said stylus along a path;

character generating means coupled with said stylus and adapted to provide character signals thereto during movement of said stylus along said path;

a control circuit coupled with said electromagnetic detecting means and said character generating means for correlating signals to said stylus with the position of said shaft;

driving circuit means electrically coupled between said stepping motor and said control circuit for providing a sequence of phasing signals to said motor for sequentially energizing said phases of said stepping motor; and means for sequentially reducing the period of said energization signals with increases in the rotational speed of said motor.

20. The printing apparatus recited in claim 19 further comprising:

strobing means with said control circuit;

strobe rate determining means electrically coupled to said strobing means for ramping up said strobe rate with voltage increases to the input thereof.

21. The printing apparatus recited in claim 20 wherein said strobe rate determining means comprises a voltage controlled oscillator.

* * * * *